United States Patent [19]

Lesas et al.

[11] 4,113,936

[45] Sep. 12, 1978

[54] CROSS-LINKING OF CELLULOSE FIBERS IN GAS SUSPENSION

[75] Inventors: Claude H. Lesas, Colmar; Michel Pierre, Mulhouse, both of France

[73] Assignee: S. A. Beghin-Say, Thumeries, France

[21] Appl. No.: 731,895

[22] Filed: Oct. 13, 1976

[30] Foreign Application Priority Data

Oct. 20, 1975 [FR] France ..... 75 31965

[51] Int. Cl.[2] ..... C08B 15/10

[52] U.S. Cl. ..... 536/56; 8/116.4; 8/120

[58] Field of Search ..... 536/56; 8/116.4, 120

[56] References Cited

U.S. PATENT DOCUMENTS

| | | | |
|---|---|---|---|
| 1,816,973 | 8/1931 | Kantorowicz | 8/116.4 |
| 2,010,635 | 8/1935 | Kantorowicz | 162/72 |
| 2,311,080 | 2/1943 | Pinkney | 8/116.4 |
| 3,046,079 | 7/1962 | Reeves et al. | 8/116.4 |
| 3,224,926 | 12/1965 | Bernardin | 8/116.4 |
| 3,230,108 | 1/1966 | Marek | 8/116.4 |
| 3,264,054 | 8/1966 | Reinhardt et al. | 8/116.4 |
| 3,287,083 | 11/1966 | Hushebeck | 8/116.4 |
| 3,310,363 | 3/1967 | Russell et al. | 8/116.4 |
| 3,440,135 | 4/1969 | Chung | 8/116.3 |
| 3,700,549 | 10/1972 | Croon et al. | 8/120 |

OTHER PUBLICATIONS

Chemical Abstracts, vol. 82, No. 14, Apr. 7, 1975, p. 87968M.

*Primary Examiner*—Ronald W. Griffin
*Attorney, Agent, or Firm*—A. W. Breiner

[57] ABSTRACT

The invention relates to a process for cross-linking cellulose with formaldehyde. The pulp is fluffed, aerated and exposed to a reaction mixture comprising formaldehyde, hydrochloric acid and formic acid as finely divided droplets or vapors. The wetted fibers are then cured in a hot air stream at 180° C during a few seconds and separated from the gaseous effluents. The whole procedure lasts less than 1 minute.

9 Claims, 1 Drawing Figure

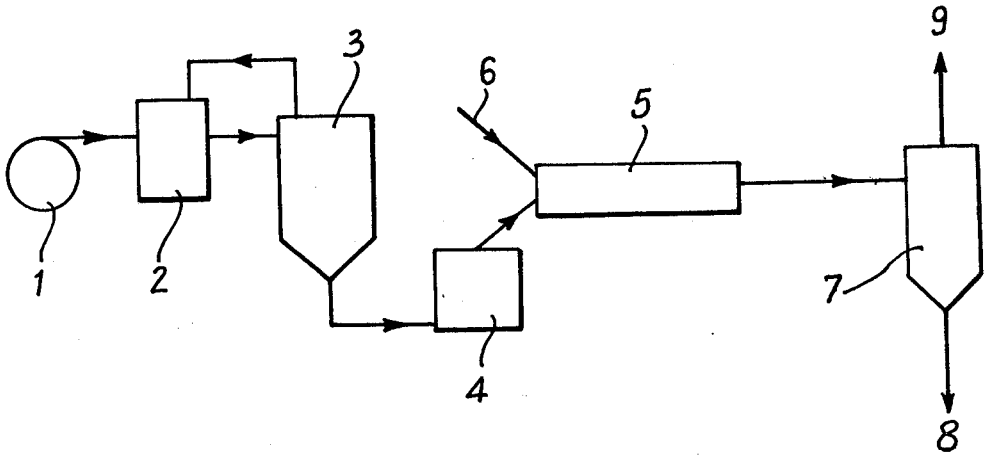
1
2
3
4
5
6
7
8
9

CROSS-LINKING OF CELLULOSE FIBERS IN GAS SUSPENSION

BACKGROUND OF THE INVENTION

1. Field of the Invention

The invention relates to the cross-linking of cellulose fibers, more particularly to wood pulp fibers.

2. Prior Art

The cross-linking reaction imparts to the cellulose fibers -wood fibers or cotton linters- new characteristics, especially a greatly increased warter absorptivity.

The links between the anhydroglucose units of the cellulose chains hinder the inter-fiber bonds, impart stiffness to the fibers and increase the water absorption through capillarity.

Cross-linked fibers are useful in the preparation of napkins, pads and diapers, but also of sheet materials having improved bulk, softness as well as reduced tensile strength. If employed with a resinous binder, the modified fibers are particularly useful in the manufacture of non-woven characterized by their improved softness, bulk, caliper and absorbency.

The cross-linked fibers are well-known in the prior art: see, or example French patent No. 892,799 (Westfalische Zellstoff) and U.S. Pat. No. 2,010,635 (J. Kantorowicz), but the technical difficulties raised up numerous searches. See for example, U.S. Pat. No. 3,224,926 (C. J. Bernardin), U.S. Pat. No. 3,440,135 (R. Chung) and U.S. Pat. No. 3,700,549.

The U.S. Pat. Nos. 3,224,926 and 3,440,135 describe processes which require an impregnation step -with the cross-linking agent or with the catalyst- and a drying or storage step for periods of time up to 48 hours, a defiberizing step and a thermal treatment step.

The formaldehyde which is the less expensive cross-linking agent and fully effective at low levels (see U.S. Pat. No. 3,224,926 col. 2, ls. 23–27) is considered as less desirable because of its volatility (see U.S. Pat. No. 3,440,135 col. 7, ls. 55–57). The use of more expensive compounds and/or the too long aging or drying steps have prevented any wide scale commercial manufacture of the cross-linked fibers.

It is also well-known that paper or cardboard might be treated with formaldehyde [see for example U.S. Patent 1,816,973 (J. Kantorowicz), U.S. Pat. No. 3,264,054 (R. Reinhardt and al), U.S. Pat. No. 3,310,363 (J. Russel and al)]. All these processes are attempts in order to improve the physical properties —especially web tensile strength— of the sheets and do not teach how to treat individual cellulose fibers. The cross-linking of the cellulose is a double etherification of the primary alcohol groups of the anhydroglucose units with the cross-linking agent. Various compounds may be used: formaldehyde, polyoxymethylene, trioxane, aminoplasts, glyoxal, etc. The reaction is catalyzed by acids (Lewis acids, low molecular weight organic acids).

Other compounds like epichlorydrine or other expoxides require a basic catalyst.

An important feature of the cross-linking reaction is the thermal treatment: the cellulose is adversely affected by heat and acids. A balance between acid concentration and temperature has to be found.

The cross-linking reaction may occur in liquid or vapor phase.

Two ways have to be distinguished among the "liquid-phase" type processes:

low fiber concentration processes high fiber concentration processes.

They are obtained by bringing to the fibers the minimum amount of cross-linking agent or by removing the excess of reagents by squeezing an impregnated sheet.

Such methods allow a good distribution of the chemicals and swelling of the fibers, especially when water or phosphoric acid are used as solvents.

The reaction is intra lamellar and the processed fibers are quite different from those obtained with dried and flat fibers.

As a matter of fact, the water content of the reaction medium is very important: in order to obtain flat cross-linked fibers less than 18% water must be used. The cross-linking reaction is then a surface modificator and even after drying —as in the papermaking art— the fibers remain unbonded. Less water content might be obtained with reactions in solvent medium: acetone, dioxane, acetic acid. In boiling acetone, the reaction time might last 30 seconds to 10 minutes. Following a method described in the French Patent No. 2,224,485:

| | Fibers | Formaldehyde | Hcl | Water | Acetone |
|---|---|---|---|---|---|
| Concentration % | 5 | 4 | 4.9 | 9.5 | 76.6 |
| | | Reaction time: 10 minutes<br>Water absorption value: 31 g/g. | | | |

However the use of such large amounts of acetone and the regeneration of the solvent-catalyst mixture prevent any industrial development of this process. The vapor phase reaction allows an excellent repartition of the reagents in the fibers, but the use of hydrochloric acid or other strong acid must be avoided. It is then necessary to use low molecular weight organic acids: formic, acetic acid. Reaction time is longer, the fibers are not damaged but the regeneration step and the acid losts are expensive. Water absorptivities between 27g/g and 29g/g are obtained.

SUMMARY OF THE INVENTION

According to the present invention cross-linked fibers are prepared by spraying the reagents on individualized fibers subsequently subjected to a heat treatment in a system used for the air transport by hot air. The reaction time is extremely short (1–10 seconds). The temperature of the fibers does not reach more than 50° C. in the 200° C. hot air and the fibers are not damaged. More precisely paper pulp is first fluffed, aerated and then exposed to the reagents (vapor-phase or finely divided droplets) which contain 1% to 6% (by weight of the pulp) of formaldehyde and a catalyst —hydrochloric acid at least as traces— and formic acid. The fibers are introduced in hot air (180° C.) during a few seconds and finely separated from the gaseous effluents.

It is the purpose of this invention to provide a new procedure for the cross-linking of cellulose fibers with formaldehyde.

It is another object of the invention to provide a process for cross-linking cellulose fibers with formaldehyde, which does not require any impregnation or aging step. It is a further object of the invention to provide a process which requires less than one minute between the fluffing step and the recuperation of the cross-linked fibers.

BRIEF DESCRIPTION OF THE DRAWING

FIG. 1 is a schematic flow-sheet of the preferred method for producing cross-linked cellulose fibers.

Fibers coming out from the fluffer 2 are dryed and aerated in the cyclone 3, then conducted in the spraying unit 4 and in the tubular reaction vessel 5 together with an hot air stream 6.

Cross-linked fibers are separated in the cyclone 7, recuperated in 8. Air and effluents to be recycled come out in 9.

DESCRIPTION OF THE PREFERRED EMBODIMENTS

The paper pulp supply 1 is fluffed by a dry-process in the fluffer 2. The pulp might advantageously contain surface active compounds. Individual fibers (length: 1–3 mm; thickness: 8–10$\mu$) without knots must be obtained.

If the fibers are collapsed together or not enough aerated, they are conducted in a high velocity air stream in order to artificially increase their volume. On the aerated fibers the reagents are uniformely deposed —by condensation of the compounds or by spraying— until the dry content of the fibers reaches 70–80%.

If a spray is used, the size of the droplets is critical as far as the efficiency and the rate of the reaction are concerned.

The preferred proportions of the reagents are given in Table I

| Compounds | % by weight of the fibers |
|---|---|
| Formaldehyde | 1 - 6 |
| Hydrochloric acid | - 2 |
| Formic or acetic acid | 0 - 12 |
| Water | 2 - 19 |

In a preferred embodiment of the invention the reagents comprise formic or acetic acid in a proportion inferior to 50% of the sum of all compounds.

Cross-linking without formic acid is still possible but more hydrochloric acid and more formaldehyde must be used.

Charing of the fibers might then occur. Furthermore, in absence of formic acid, formaldehyde is more volatile and the reaction is difficult to control.

The amount of hydrochloric acid is one of the most important parameters. An excess leads to a yellowing of the fibers.

According to a preferred embodiment of the invention, 0.1%–0.2% (by weight of the pulp) of hydrochloric acid (or one Hcl salt) is the optimal amount.

Formic acid might be avoided, but the cross-linked fibers are then less water absorbent. Formic acid might be considered as a weak catalyst, an anchorage agent of the formaldehyde on the fibers and a swelling agent for the fibers.

Water might be used in order to dilute the mixture of reagents. The wetted fibers are cured in the tubular air-dryer 5 wherein the temperature might vary between 60° C. and 250° C. and the speed of the air stream might vary between 1 and 20 m/s.

The cross-linked fibers are separated from the gaseous effluents in the cyclone 7. It might be necessary to dry them again in order to remove all the contaminants.

EXAMPLES I TO V

Every curing step has been conducted as a flash-dry ing at 180° C. during 2.5 seconds.

| Composition of the mixture % - The amount sprayed is about 20 to 25% by weight of the fibers | | Color of the cross-linked fibers | Water absorbents g/g | Comments |
|---|---|---|---|---|
| HCHO | 20 | dark brown | 29 | — |
| HCl | 12 | | | |
| Water | 68 | | | |
| HCHO | 19.5 | white | 15 | Reagents still present on the fibers |
| HCOOH | 28 | | | |
| Water | 52.5 | | | |
| HCHO | 19 | white | 33 | — |
| HCOOH | 27.7 | | | |
| HCl | 0.8 | | | |
| Water | 52.5 | | | |
| HCHO | 19 | light yellow | 30–31 | |
| HCl | 0.8 | | | |
| Water | 80.2 | | | |
| HCHO | 18 | yellow | 31 | with less catalyst white fibers might be obtained |
| HCOOH | 27.5 | | | |
| $NH_4Cl$ | 4.4 | | | |
| $H_2O$ | 50.1 | | | |

The water absorption is measured as follows:

A handsheet (5g pulp) is made on a lab equipment and dryed 2 minutes under 3.5Kg/cm$^2$. The handsheet is post-dryed 2 hours in an air-forced oven at 105° C. The degree of cross-linking might be found by a bulk determination.

The handsheet is placed in a cylindrical basket with a conical bottom.

The closed basked is dipped in a vessel containing 1 liter water during three minutes. The basket is removed and drained 1 minute. The amount of water remaining in the vessel is measured.

An untreated pulp sheet absorbs between 3 and 5g/g.

What we claim is:

1. A process for treating cellulose fibers with formaldehyde comprising the steps of -
   (1) spraying of formaldehyde as a mixture with hydrochloric acid and formic acid on individualized cellulose fibers;
   (2) immediately after said spraying, introduction of said fibers which have the reagents of step (1) uniformly disposed thereon in an air stream having a temperature of from 60° to 250° C. and a velocity of from 1–20 m/sec during a curing-time period ranging between 1 and 10 seconds to effect a cross-linking reaction, and
   (3) separating said fibers from said air stream.

2. The process according to claim 1 wherein the air stream has a temperature between 170° to 180° C.

3. The process according to claim 1 wherein said individual fibers are obtained through the step of fluffing pulp.

4. The process according to claim 3 wherein the steps from fluffing to separating of said fibers from said air stream are carried out within less than 1 minute time.

5. The process according to claim 3 wherein the fluffed pulp is heated.

6. The process according to claim 1 wherein the amount of formic acid used in the mixture is less than 50% by weight with respect to the reagents.

7. The process according to claim 6 wherein the amount of formic acid used is less than 12% by weight with respect to the fibers.

8. The process according to claim 1 wherein the amount of hydrochloric acid used is from trace amounts to 2% by weight with respect to the fibers.

9. The process according to claim 1 wherein the fibers are retained in the air stream for 2 to 3 seconds.

* * * * *